US006655103B1

(12) United States Patent
Lueghamer

(10) Patent No.: US 6,655,103 B1
(45) Date of Patent: Dec. 2, 2003

(54) PLASTIC PANEL, IN PARTICULAR FOR LINING CONCRETE COMPONENTS

(75) Inventor: Albert Lueghamer, Sierning (AT)

(73) Assignee: Alois Gruber GmbH (AT)

( * ) Notice: Subject to any disclaimer, the term of this patent is extended or adjusted under 35 U.S.C. 154(b) by 0 days.

(21) Appl. No.: 09/744,971

(22) PCT Filed: Jan. 31, 2000

(86) PCT No.: PCT/EP00/00729

§ 371 (c)(1),
(2), (4) Date: Feb. 14, 2001

(87) PCT Pub. No.: WO01/57340

PCT Pub. Date: Aug. 9, 2001

(51) Int. Cl.[7] ..... E04B 5/04; E04C 2/04

(52) U.S. Cl. ..... 52/598; 52/247; 52/443; 52/447; 264/33; 264/274; 428/195; 428/207; 428/212; 428/403

(58) Field of Search ..... 52/19, 20, 245, 52/247, 264, 598, 443, 447; 264/33, 274; 428/195, 207, 212, 403, 344, 369.1

(56) References Cited

U.S. PATENT DOCUMENTS 5,167,895 A * 12/1992 Lueghamer ..... 264/210.2
5,168,682 A * 12/1992 Rye ..... 52/309.17
5,425,979 A 6/1995 Lueghamer ..... 428/195

FOREIGN PATENT DOCUMENTS

WO 96/16790 6/1996

* cited by examiner

*Primary Examiner*—Carl D. Friedman
*Assistant Examiner*—Chi Q. Nguyen
(74) *Attorney, Agent, or Firm*—Rothwell, Figg, Ernst & Manbeck

(57) ABSTRACT

A concrete-protecting panel with integrated undercut protuberances which has an enhanced resistance to groundwater pressure. The protuberances or wing-element pairs (3) of the plastic panel (1) have spread wing elements (3) which may spread open even further in their top region 3.1. The wing elements 3 are connected to one another by a supporting web 4, of which the height is at least 70% of one wing-element pair. The wing-element pairs 2 are fastened on the base plate 5 of the protuberance-containing panel 1 via a foot widened in an arcuate manner.

16 Claims, 7 Drawing Sheets

Figure 6:
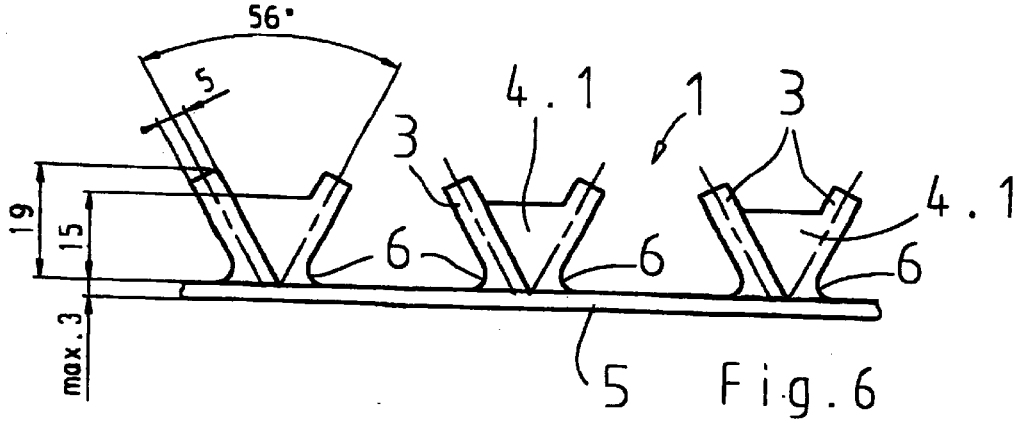

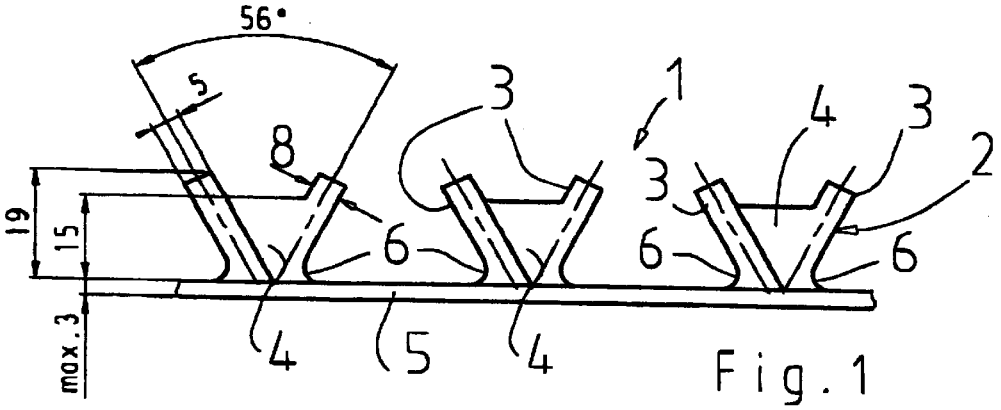
Fig. 1
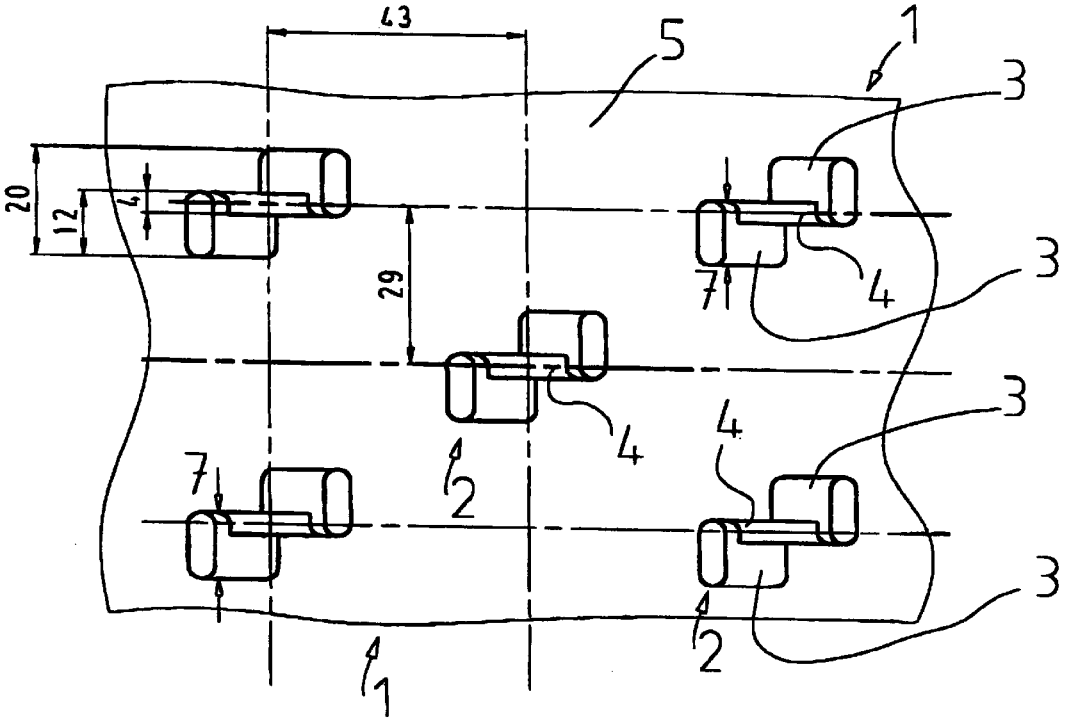
Fig. 1.1

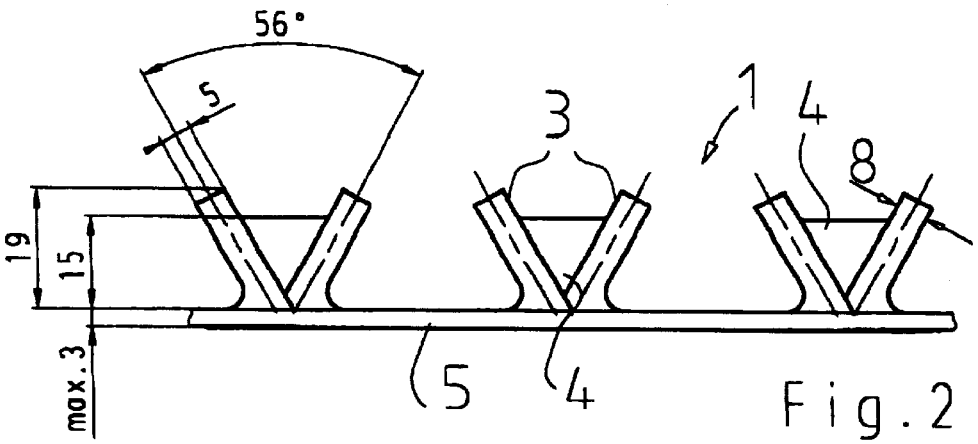
Fig.2
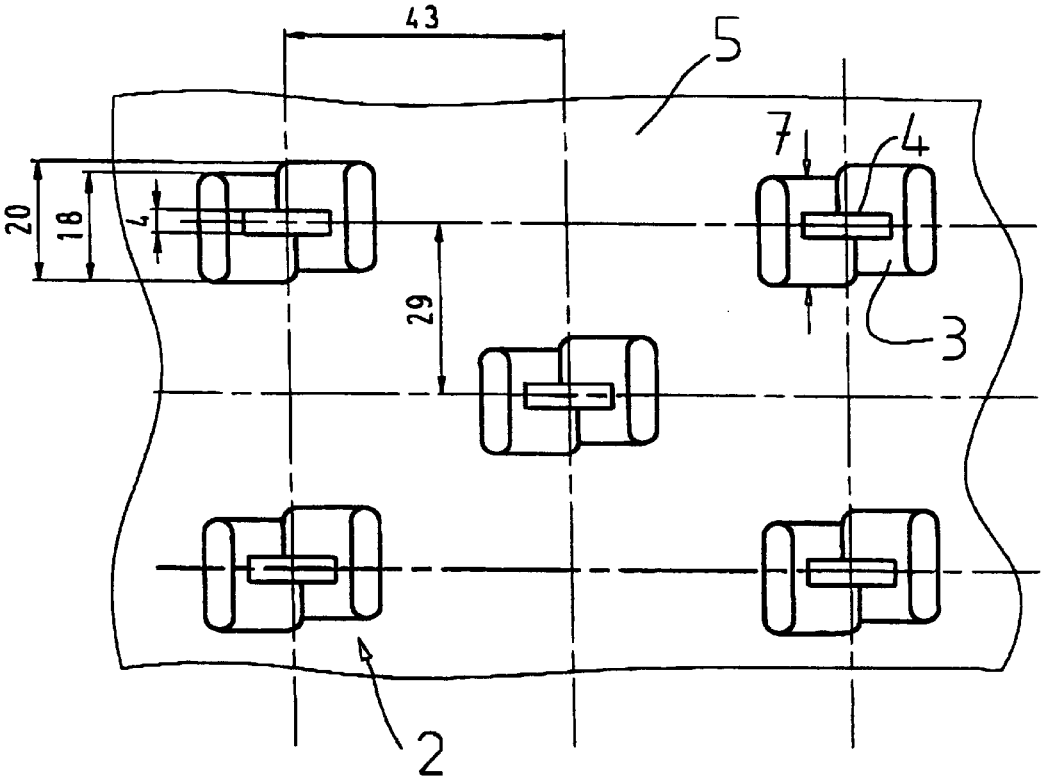
Fig.2.1

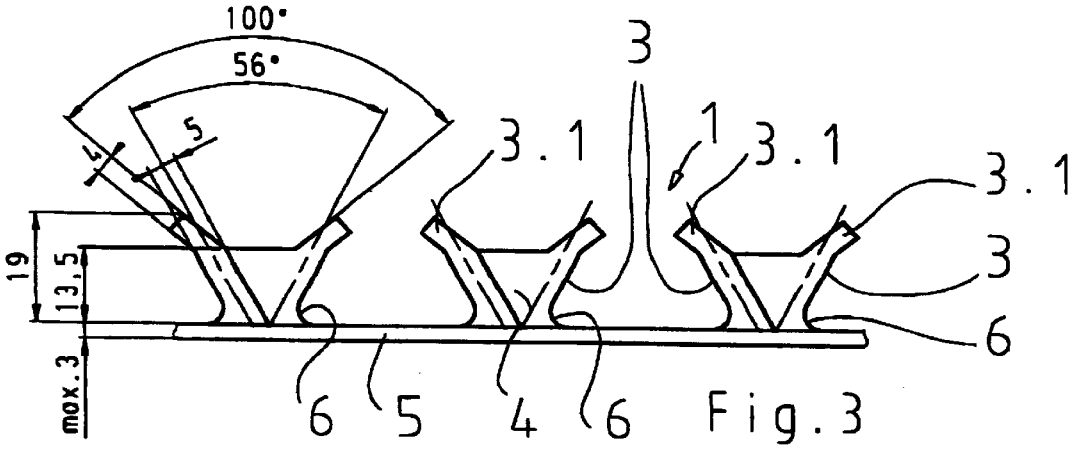
Fig.3
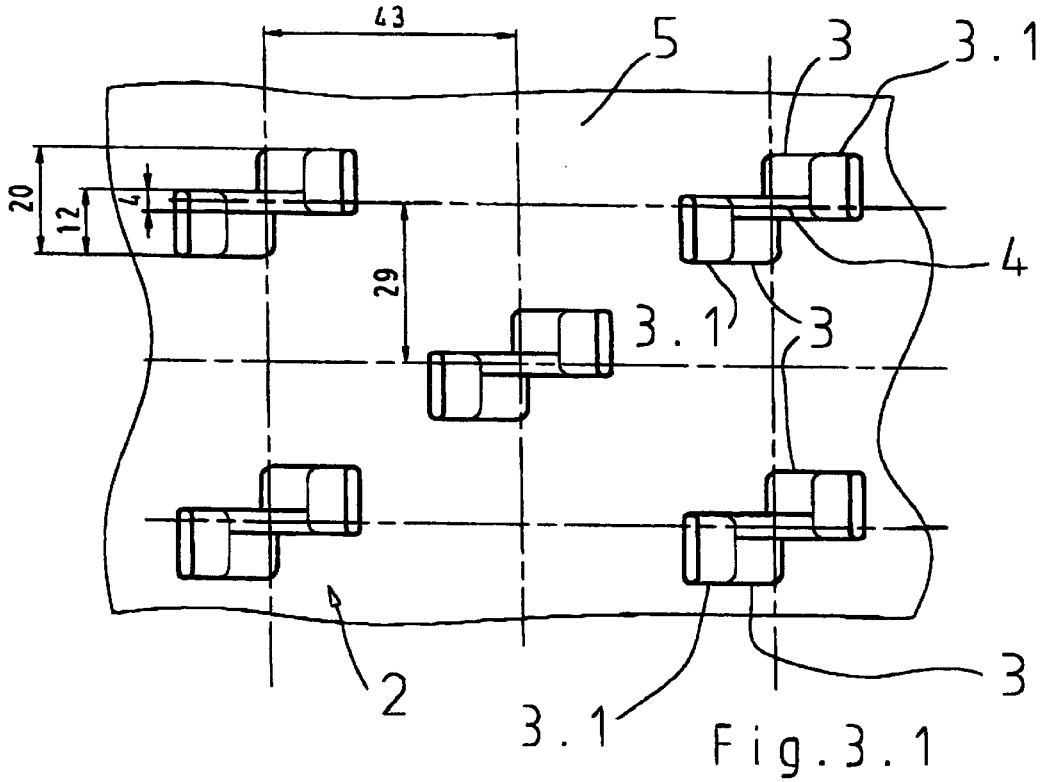
Fig.3.1

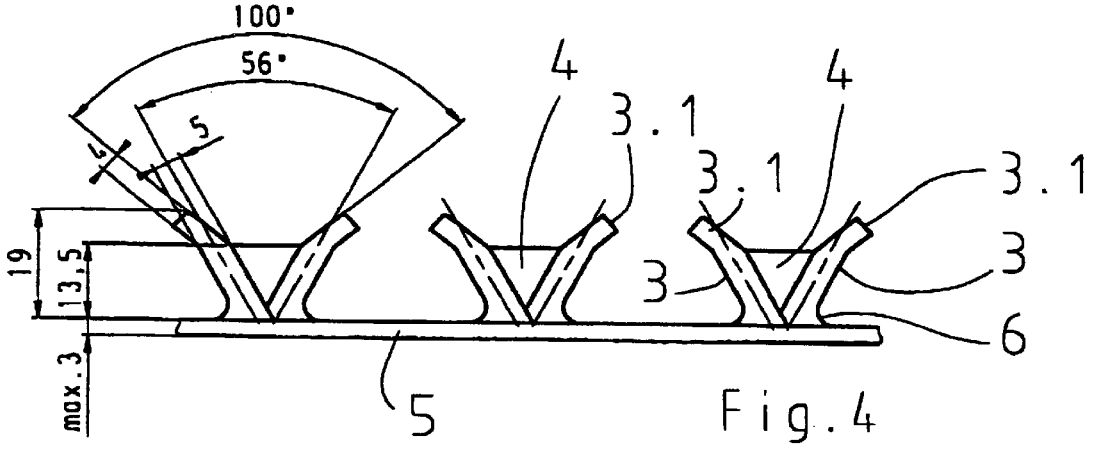
Fig.4
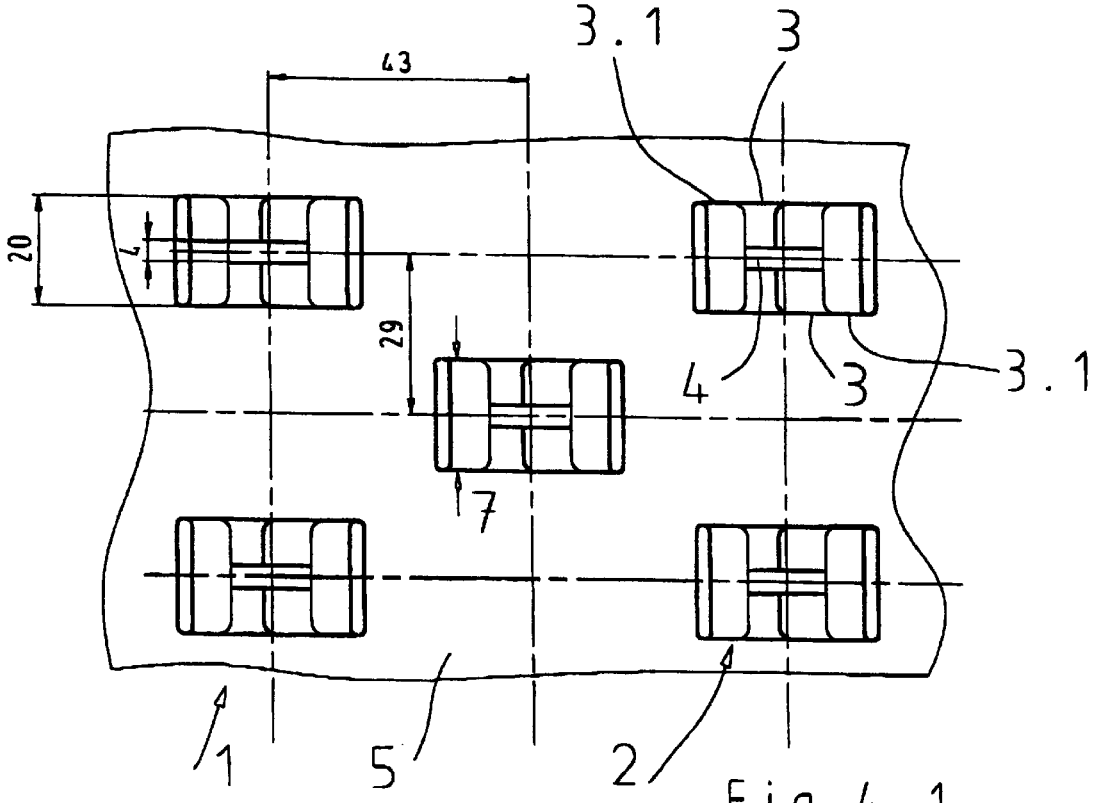
Fig.4.1

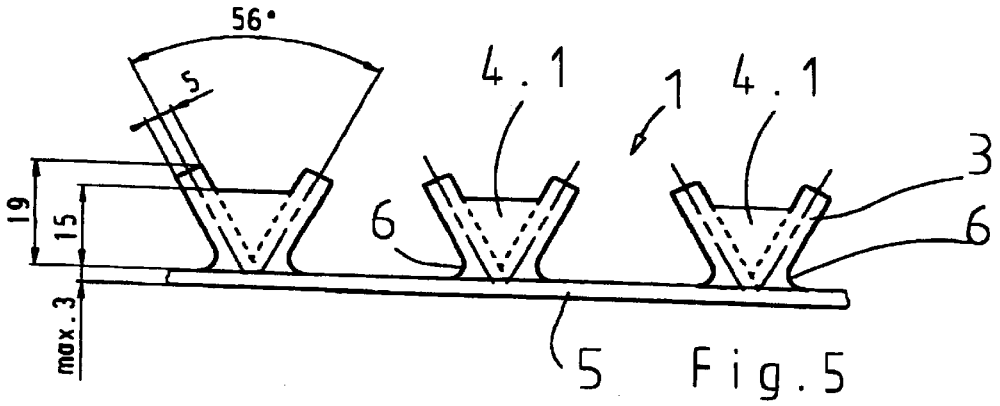
Fig.5
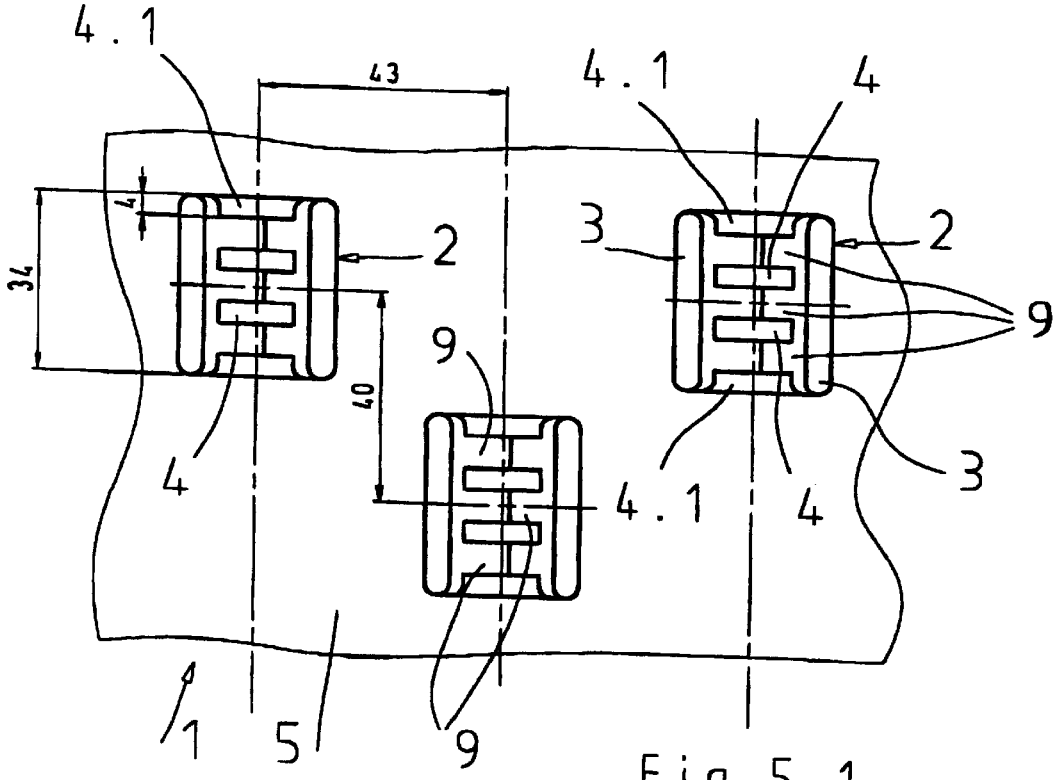
Fig.5.1

Fig.6.1

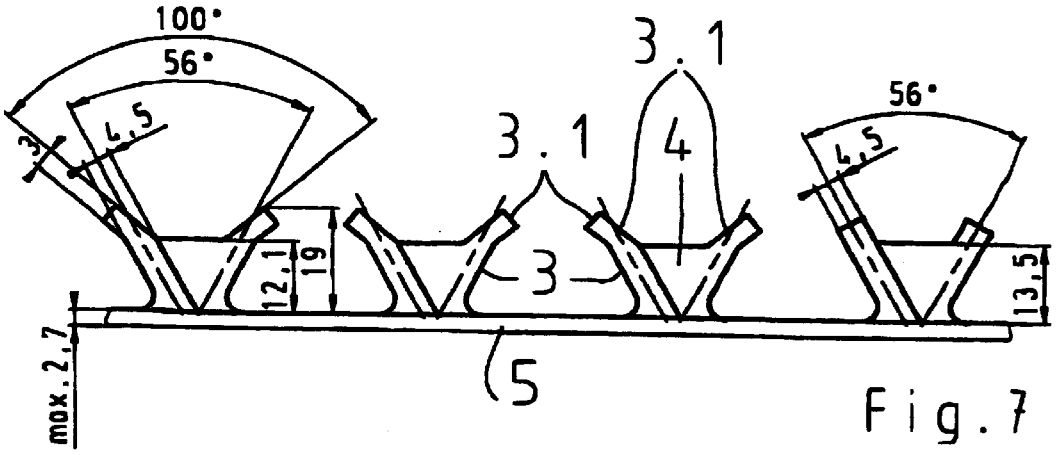
Fig. 7
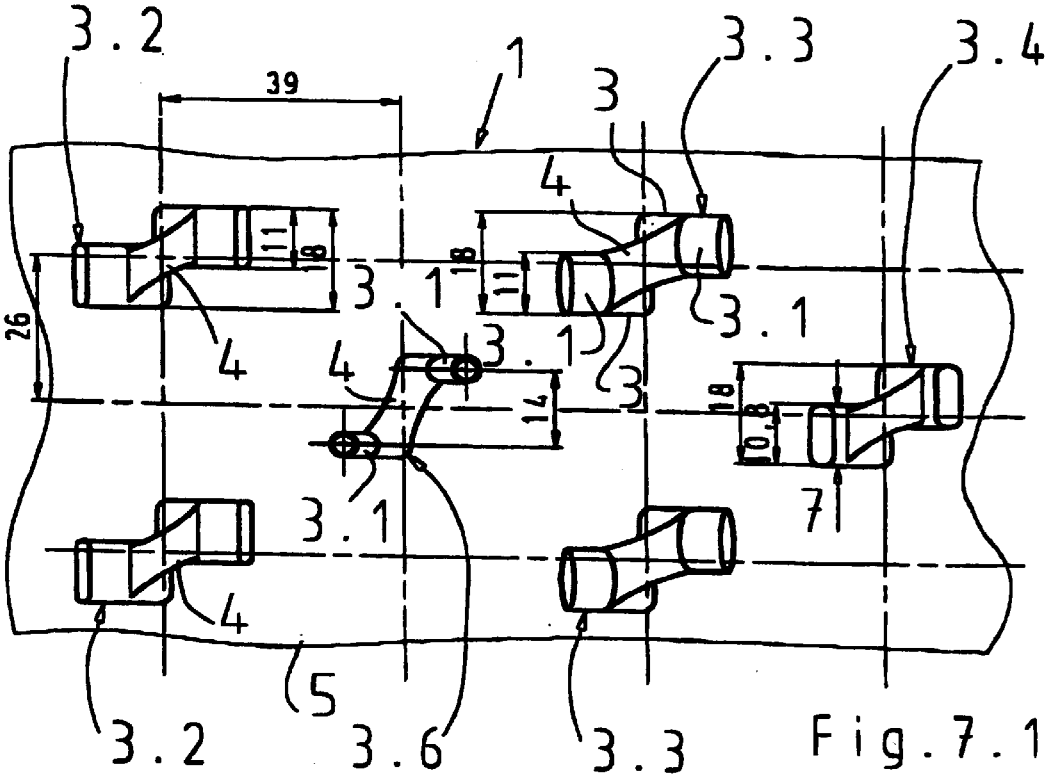
Fig. 7.1

PLASTIC PANEL, IN PARTICULAR FOR LINING CONCRETE COMPONENTS

CROSS REFERENCE TO RELATED APPLICATION

This application is a 35 USC § 371 National Phase Entry Application from PCT/EP00/00729, filed Jan. 31, 2000, and designating the U.S.

The invention relates to a plastic panel, in particular for lining concrete components, preferably made of thermoplastic material, having spreading wing elements which are integrally formed on at least one side of the plastic panel and have supporting webs in their foot region.

Protuberance-containing panels made of plastic are used, in particular, in concrete-tank construction if the intention is to produce liquid-tight and gas-tight, chemical-resistant tanks. The plastic panels form the lining of such tanks. They provide the resistance against the chemicals and liquids. The mechanical strength of the overall structure is provided essentially by the concrete structure. Connecting the plastic panels to the concrete structure usually poses problems since the smooth plastic panel does not undergo fixed mechanical connection to the concrete. Adhesives are of no assistance in producing results which are satisfactory over the long term.

For this reason, various anchoring elements with undercuts have been proposed, said elements being provided on one side of the plastic panel and being concreted in during production of the tank. This does indeed achieve the desired fixed connection between the plastic panel and concrete substructure, but the operation of providing the known anchoring elements on the plastic panels involves comparatively high outlay since it takes place subsequently and requires a number of steps.

EP 0 436 058 B1 discloses a protuberance-containing panel of the type in question and a method of producing the same, with the aid of which it is possible to produce plastic panels which are intended for lining concrete structures and have protuberances provided integrally on them. The protuberances are spreading wing elements which are concreted in when concrete components or concrete structures are lined with the plastic panel. On account of the continuous production using the method described in said patent specification, said protuberance-containing panels can be produced continuously and thus comparatively inexpensively. In addition, the spread wing elements and the undercutting which is thus provided in practice result in very durable fastening of the plastic-panel lining on the concrete structure.

It has been found, however, that there is a need for such protuberance-containing panels which, in the case of underground installation, have particular resistance to groundwater pressure.

The object of the invention is thus to provide a plastic panel of the type mentioned in the introduction, in particular for lining concrete components, which withstands groundwater pressures in a range of $\geqq 1.5$ bar even over the long term. Furthermore, said protuberance-containing panel is also to be producible by cost-effective calendering.

This object of the invention is achieved in that the height of the supporting webs is at least 70%, preferably at least 80%, of the height of the wing elements, the latter having arcuate transitions to the plastic panel in their foot region.

With the design of the wing elements according to the invention, the specific configuration of the supporting webs and of the foot regions of each wing-element pair achieves the sought-after enhanced long-term strength of the protuberances formed in this way and of their anchoring on the actual plastic panel. Long-term investigations have shown that the long-term resistance to ground water pressure when concrete components or concrete structures are lined is from 1.5 to 6.0 bar. By way of these excellent values, the plastic panel according to the invention is suitable, in particular, for lining buried sewage-pipe systems.

Figure 8:
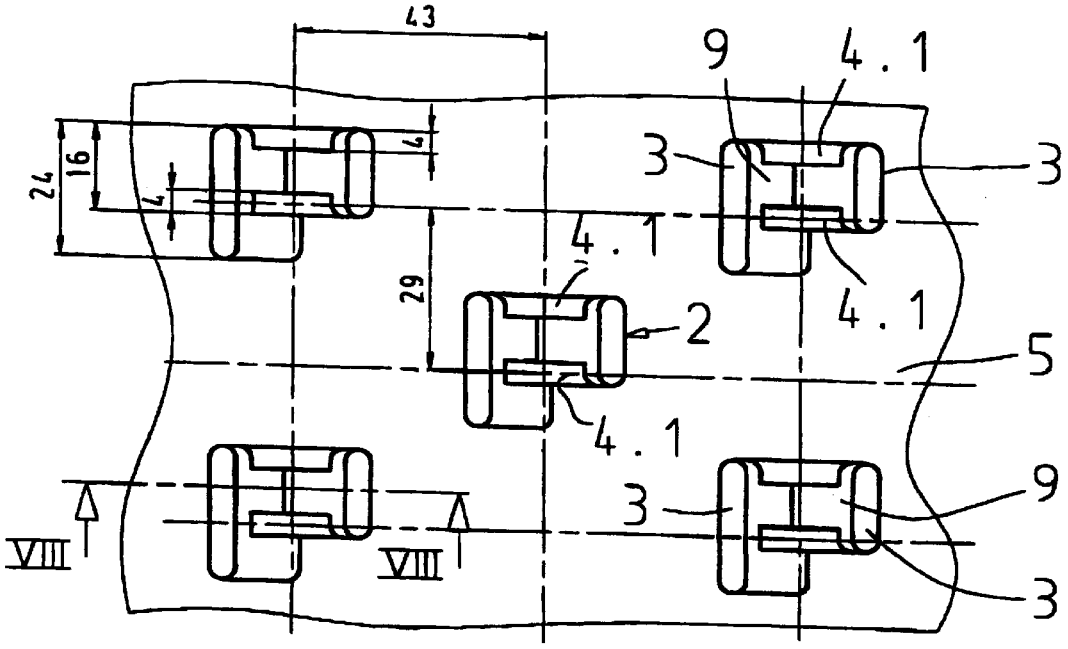
Figure 8:
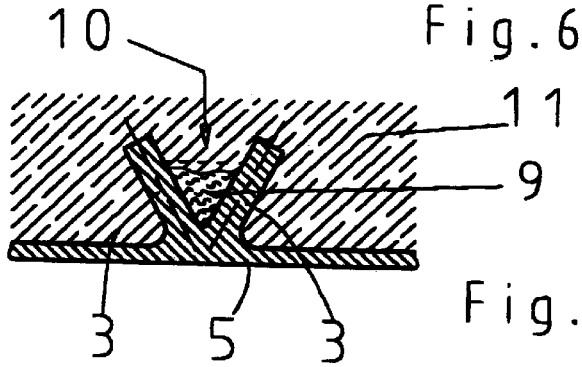

Further details, features and advantages of the invention can be gathered from the following description of a number of preferred exemplary embodiments and with reference to the schematic drawing and the patent claims. In the drawing, in incomplete form in each case:

FIG. 1 shows a side view of a first embodiment of the invention;

FIG. 1.1. shows a plan view of the subject matter of FIG. 1;

FIGS. 2 to 7 also show side and plan views of further exemplary embodiments of the plastic panel according to the invention; and FIG. 8 shows a section along VIII—VIII from FIG. 6.

In the following description, the same basic parts of the plastic or protuberance-containing panel 1 according to the invention are provided with the same or similar designations, so there is no need for all the figures to be described in detail. With this in mind, FIG. 1 will be discussed first of all. This figure shows the plastic or protuberance-containing panel 1 according to the invention with a base plate 5 on which protuberances 4 or wing-element pairs 2 are provided in an integral manner. The latter each comprise two spreading wing elements 3 which are connected to one another via a supporting web 4. Wing elements 3, webs 4 and base plate 5 are thus all integral with one another. As has been mentioned, they are produced by extrusion calendering.

The present drawing, and likewise FIG. 1, contain measurements in mm and degrees. They represent preferred values of the protuberance-containing panel 1 according to the invention. As far as the supporting webs 4 are concerned, it should be pointed out that their height is at least 70%, preferably 80% or more of that of the wing elements 3. As can equally be gathered from the figures, the wing elements merge into the base plate 5 in the form of an arc 6 at their feet. This transition is preferably continuous. This gives a comparatively wide connecting surface between the protuberances 2 and this very base plate 5, with correspondingly reduced tensile loading per unit surface area in the foot region of the protuberances. The radius of the arc 6 is preferably approximately 50% of the thickness of a wing element in the view according to FIG. 1.

As the drawings show, the wing elements 3 enclose a spreading angle which is usually 50 to 60 degrees; it is preferably 56 degrees.

The wing elements 3 or protuberances of the wing-element pairs 2 according to FIGS. 1 and 1.1 are offset in relation to one another essentially over their width 7, as can be gathered from FIG. 1.1. It can likewise be seen in said figures that they are connected to one another via the webs 4 at their two mutually adjacent border regions.

FIG. 2 shows a modified embodiment of the subject matter of FIG. 1. In this case, as FIG. 2.1 shows, the wing elements 3 are designed to be wider than the wing elements 3 of FIG. 1. Their thickness 8 is the same. Furthermore, in contrast to FIG. 1, they are offset in relation to one another only to a slight extent. The webs are arranged approximately centrally in terms of the width 7.

The embodiment of the protuberance-containing panel 1 according to the invention in FIGS. 3 and 3.1 differs from that in FIGS. 1 and 2 essentially in that the wing elements 3 are bent outward in their top region 3.1, which is located opposite the foot region with the arcs 6, and in that the top regions 3.1 thus enclose a larger spreading angle than the actual wing elements 3. This can be gathered from FIG. 3. The spreading angle of the wing elements 3 there is 56 degrees in the foot region; that of the top region 3.1 of the wing elements 3 is >90 degrees.

The larger spreading angle in the top region 3.1 of the wing elements brings about improved adherence of the wing-element pairs 2 overall in the concrete substructure.

Otherwise, the wing elements 3 of each wing-element pair 2 are arranged in the same way as in the exemplary embodiment according to FIG. 1, as a comparison of FIGS. 3.1 and 1.1. shows.

FIGS. 4 and 4.1 show a similar embodiment of the protuberance-containing panel according to the invention. The wing elements 3 of the individual wing-elements pairs, again, are spread further outward in the top regions 3.1 than in the region which extends up to the top end of the supporting web 4. The wing elements 3 are comparatively wide; see designation 7. They are provided in alignment with one another, that is to say they are not offset in relation to one another. The supporting webs 4 are each provided centrally in terms of the width 7 of the wind elements.

FIGS. 5 and 5.1 show wing-element pairs with a plurality of supporting webs 4 per wing-element pair 2. In the present case, there are four supporting webs 4, the two outer supporting webs being referred to as end supporting webs 4.1. The wing elements 3, in turn, are provided in alignment with one another. This establishes three depressions 9 which have an advantageous effect insofar as, in the case of the protuberance-containing panel 1 being subjected to ground water pressure on the concrete structure, a certain additional groundwater pressure can build up there and thus contributes to relieving the loading on the foot region of the wing-element pairs in the region of the arcs 6.

This condition is illustrated more precisely in FIG. 8. An arrow 10 represents the groundwater pressure which is building up within the depressions 9. Accumulated water is shown in the depressions 9. The concrete surrounding the protuberance-containing panel according to the invention is designated 11.

FIG. 6, finally, illustrates a further variant of the plastic panel 1 according to the invention. The wing-element pairs 2 here have a uniform spreading angle. The wing elements 3 are of different widths. Two supporting elements connect the wing elements 3 to one another. The outer edges of the smaller-thickness element 3 are connected to the wider wing element 3 located opposite, with the result that the depression 9 extends over the width of the smaller-width wing element 3. The larger-width wing element 3 projects beyond said depression 9, as is shown in the plan view of FIG. 6.1. FIGS. 7 and 7.1 show further possible exemplary embodiments of the invention, irrespective of whether the wing elements 3 are spread wider in their top region 3.1 or have diagonally arranged supporting webs 4 between the mutually offset wing elements 3; see FIG. 7.1. Four protuberance shapes 3.2 to 3.6 are shown for this purpose. In this case, the supporting webs 4 assume approximately the width 7 of the supporting webs in the connecting region between the supporting web 4 and wing element 3. Between the two wing elements, however, it is possible for the supporting webs 4 to taper or become narrower, as is illustrated in FIG. 7.1.

Examples of the thermoplastic material for the plastic panel 1 according to the invention are, in particular, PVC, PE, PP, PVDF and ECTFE. The plastic panel 1 according to the invention may be produced, in particular, by the method described in EP 0 436 058 B1. This European patent specification is expressly made part of the subject matter of the present disclosure.

What is claimed is:

1. A plastic panel (1), usable to line concrete components, comprising:

a base plate having a first side and a second side opposite said first side; and at least one pair of spreading wing elements (3) integrally formed on and extending from at least one of said first and second sides of the base plate, wherein each of said wing elements has a first end integrally attached to said base plate and a free second end opposite said first end, each of said wing elements extending obliquely relative to said base plate, wherein each of said pair of wing elements defines a V-shaped profile with a foot region formed at a vertex of said V-shaped profile, wherein a supporting web (4) is provided in said foot region, wherein a height of the supporting web (4) is at least 70%, relative to a height of the wing elements (3), and wherein the wing elements (3) have arcuate transitions (6) to the base plate (5) in the foot region.

2. The plastic panel as claimed in claim 1, wherein a radius of the arcuate transition is approximately 50% of the thickness of a wing element.

3. The plastic panel as claimed in claim 1 wherein the wing elements (3) enclose a larger spreading angle at said free second ends, beginning from an end of the supporting web (4) which is directed away from the base plate, than in the region of the supporting elements (3).

4. The plastic panel as claimed in claim 1, wherein in each case two wing elements (3) are offset in relation to one another and are connected to one another via at least one supporting web (4).

5. The plastic panel as claimed in claim 4, wherein the wing elements (3) of a wing-element pair (2) are offset in relation to one another virtually over an entire width and are connected to one another in mutually adjacent regions via the supporting web (4).

6. The plastic panel as claimed in claim 1, wherein the wing elements (3) of a wing-element pair (2) are aligned with one another and the respective supporting web (4) is provided symmetrically between the wing elements.

7. The plastic panel as claimed in claim 1, wherein the wing-element pairs (2) each have two end supporting webs.

8. The plastic panel as claimed in claim 1, wherein in each case one end supporting web is provided on both sides of the wing-element pairs (2) with wing elements (3) of the same width.

9. The plastic panel as claimed in claim 8, wherein additional supporting webs (4) are provided between the end supporting webs.

10. The plastic panel as claimed in claim 7, wherein the wing elements (3) are of different widths (7) and the supporting webs (4) extend from the longitudinal sides of the smaller-width wing element (3) perpendicularly to the larger-width wing element (3).

11. The plastic panel as claimed in claim 1, wherein the mutually offset wing elements (3) of a wing-element pair (2) are connected to one another via in each case one supporting web (4) which is of essentially the same width as the wing elements (3).

12. The plastic panel as claimed in claim 1, wherein a width (7) of the supporting web (4) between a pair of wing elements (3) is smaller than in a region connecting two pairs of wing elements (3).

13. The plastic panel as claimed in claim 1, wherein the wing elements are of rectangular, square or polygonal cross section.

14. The plastic panel as claimed in claim 13, wherein the wing elements have beveled or rounded edges.

15. The plastic panel as claimed in claim 1, wherein the wing elements are of round, oval or elliptical cross section.

16. The plastic panel as claimed in claim 2, wherein the wing-element pairs (2) each have two end supporting webs.

* * * * *